United States Patent [19]

Suzuki et al.

[11] Patent Number: 4,935,111

[45] Date of Patent: Jun. 19, 1990

[54] METHOD FOR PRODUCING BLACK COLORED STEEL STRIP

[75] Inventors: Sachiko Suzuki; Katsuhei Kikuchi; Nobuo Totsuka; Takao Kurisu, all of Chiba, Japan

[73] Assignee: Kawasaki Steel Corp., Hyogo, Japan

[21] Appl. No.: 343,074

[22] Filed: Apr. 25, 1989

[30] Foreign Application Priority Data

Apr. 28, 1988 [JP] Japan ..... 63-107012
Feb. 21, 1989 [JP] Japan ..... 01-40704

[51] Int. Cl.[5] ..... C25D 7/06
[52] U.S. Cl. ..... 204/28; 204/56.1
[58] Field of Search ..... 204/28, 35.1, 42, 56.1

[56] References Cited

FOREIGN PATENT DOCUMENTS 5732749 12/1986 Japan .
6110798 9/1988 Japan .
61143594 9/1988 Japan .

*Primary Examiner*—T. M. Tufariello
*Attorney, Agent, or Firm*—Bierman and Muserlian

[57] ABSTRACT

A black colored steel strip having improved degree of blackness and uniform appearance is prepared by subjecting a Zn-Ni alloy plated steel substrate to anodic electrolysis or alternating current electrolysis in an electrolyte solution containing at least one member selected from the group consisting of hydroxide, sulfate, and chloride of sodium, potassium, or nickel; nitrate ion; and at least one member selected from an inhibitor and a complexing agent.

6 Claims, 5 Drawing Sheets

METHOD FOR PRODUCING BLACK COLORED STEEL STRIP

BACKGROUND OF THE INVENTION

This invention relates to a method for producing a black colored steel strip.

Black colored steel strips are finding wide application in household appliance, copying machine, communication equipments, automobile components, and interior building materials. Conventional processes for producing such black colored steel strips include (1) black film coating, (2) chemical treatment, (3) black chromate treatment, and (4) anodic treatment. Among these, anodic treatment is known to results in a steel strip having improved degree of blackness.

Japanese Patent Publication Nos. 61-60915, 63-46158, and 63-46159 relate to a production of black colored steel strips by subjecting a zinc alloy-plated steel strip to anodic electrolysis in an electrolyte containing sulfate, nitrate, or the like.

The black colored steel strips prepared by such an anodic electrolysis have high degree of blackness as well as excellent appearance when they are prepared in a freshly prepared electrolyte.

During the anodic electrolysis, metals including zinc dissolve out of the zinc alloy-plated layer. The dissolved metals, when they reach certain concentration, form white corrosion products which deposit on the steel substrate, leading to a deteriorated degree of blackness as well as nonuniform appearance. Therefore, in a continuous line employing the conventional electrolyte solution, color tone of the resulting black colored steel strip varied with an increase in the amount of the steel strip being treated.

In order to produce uniformly black colored steel strips in the above-described bath, various supplemental processes including constant addition of the freshly prepared electrolyte solution and continuous zinc removal were necessary. Such supplemental processes suffered from various critical defects for an industrial-scale production including difficult process control as well as increased production cost.

There are strong demands for uniformly colored black steel strips having a high degree of blackness expressed in L value of less than 15 in the field of household appliance, copying machine, and the like. The aforementioned prior art anodic electrolysis, however, was insufficient for preparing such black colored steel strips required in these applications.

The inventors of the present invention have made an extensive investigation and found that an incorporation of an inhibitor primarily comprising a nitrogen compound, a sulfur compound, an amine, or a halogen compound into the electrolyte solution prevents the deposition of zinc-containing corrosion products onto the surface of the steel strip, thereby improving the degree of blackness of the resulting products. It has also been found that an incorporation of a complexing agent such as citric acid, EDTA, oxalic acid, and tartaric acid prevents the formation of the corrosion products, again improving the degree of blackness.

SUMMARY OF THE INVENTION

An object of the present invention is to provide a method for producing a black colored steel strip having a high degree of blackness as well as uniform appearance.

Other objects and advantages of the invention will become apparent as the description thereof proceeds.

According to the present invention, there is provided a method for producing a black colored steel strip wherein a Zn-Ni steel strip is subjected to an electrolysis in an electrolyte solution containing at least one member selected from the group consisting of hydroxide, sulfate, and chloride of sodium, potassium, or nickel; nitrate ion; and at least one member selected from an inhibitor and a complexing agent.

The electrolysis carried out is either anodic electrolysis or alternating current electrolysis.

The inhibitor is preferably at least one member selected from the group consisting of inhibitors primarily comprising a nitrogen compound, a sulfur compound, an amine, or a halogen compound.

The complexing agent is preferably at least one member selected from the group consisting of citric acid, EDTA, oxalic acid, and tartaric acid.

The inhibitor and/or the complexing agent is added to a total amount of about 0.001 to 100 g/l of the electrolyte solution.

DETAILED DESCRIPTION OF THE INVENTION

Figure 1:
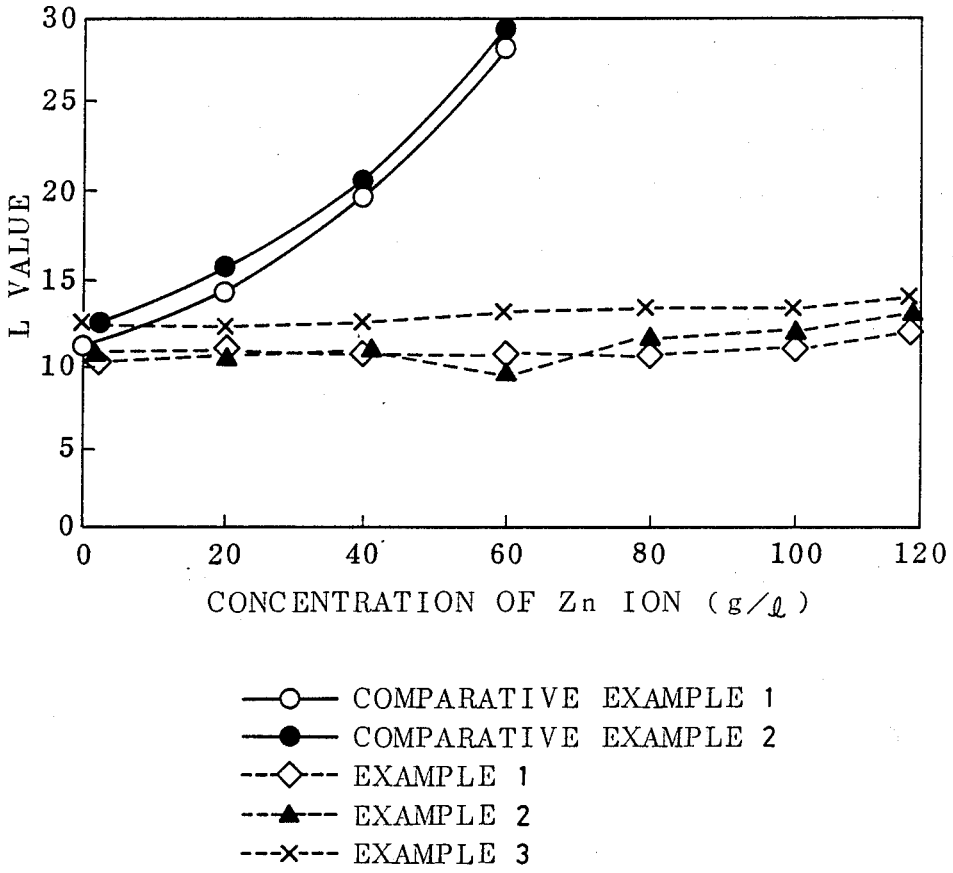
FIGS. 1 through 5 are diagrams illustrating the degree of blackness expressed in L value of the black colored steel strips prepared in accordance with the Examples and Comparative Examples of the present invention in relation to the concentration of the zinc ion in the electrolyte solution.

The organization of the present invention will be described in detail.

The steel substrate which is treated in accordance with the method of the present invention is a zinc-nickel alloy plated steel strip. The process of zinc-nickel alloy plating is not particularly limited so long as the nickel content in the plated layer is in the range of from 5 to 20% by weight and the coating weight is at least 7 $g/m^2$. The zinc-nickel alloy layer may be deposited either directly onto the steel substrate or on intervening underlying layers.

The electrolyte solution in which the zinc-nickel alloy plated steel strip is subjected to the electrolysis may preferably contain a compound selected from hydroxide, sulfate and chloride of sodium, potassium, or nickel at a total amount of 75 to 200 g/l. At an amount of less than 75 g/l conductivity of the electrolyte solution is too low for carrying out a high-speed line process at high current density. At an amount of over 200 g/l which is in proximity of the saturated solubility of the salt in the electrolyte solution, the salt may precipitate at certain bath temperature.

The electrolyte solution may preferably contain nitrate ion at an amount of from 2 to 100 g/l of the electrolyte solution. At an amount of less than 2 g/l the formation of the black colored layer is insufficient to obtain the desired degree of blackness. At an amount of over 100 g/l the steel substrate may be dissolved to result in a deteriorated adhesion between the zinc-nickel plating layer and the steel substrate.

As mentioned above, the uniformly colored steel strip having high degree of blackness according to the present invention is obtained by adding the inhibitor and/or the complexing agent into the electrolyte solution.

The inhibitors which may preferably be employed in the present invention include inhibitors primarily containing nitrogen compounds such as toluidine and morpholine, sulfur compound such as thiourea and alkyldisulfide, amine compound such as β-naphthylamine and triethanolamine, halogen compound such as potassium iodide and potassium chloride, and their derivatives. These inhibitors are equivalently effective for improving the degree of blackness. The inhibitors are adsorbed onto the steel substrate and prevent the zinc containing corrosion products from being deposited onto the steel substrate.

The complexing agents which may preferably be employed in the present invention include citric acid, EDTA, oxalic acid, and tartaric acid. These complexing agents have equivalent effects. The complexing agent forms a complex with the zinc dissolved from the zinc-nickel alloy layer during the electrolysis, thereby preventing the corrosion products from being produced. Complexing agents other than those mentioned above may also be employed so long as they form a complex with the zinc ion.

The inhibitor and/or the complexing agent is employed at an amount of from about 0.001 to about 100 g/l since no significant effect is obtained at an amount of less than 0.001 g/l and no significant improvement in the effect is obtained at an amount in excess of 100 g/l.

The steel substrate may be colored either by anodic electrolysis or by alternating current electrolysis. The electrolytic conditions are selected in terms of the degree of blackness obtained as well as the operating convenience.

The anodic electrolysis, namely, the anodic oxidation is carried out at a current density of 30 to 200 A/dm$^2$ to an electricity quantity of 50 to 500 C/dm$^2$.

The alternating current electrolysis is carried out at a ratio of anodic electrolysis time to cathodic electrolysis time of 1:0.1 to 1:1, frequency of 1–50 Hz, total electrolytic time of 1 to 30 sec., anodic electrolysis current density of 5 to 100 A/dm$^2$, and a ratio of anodic current density to cathodic current density of 1:0.1 to 1:1.

The alternating current electrolysis may be carried out by using an alternating current having a rectangular wave.

The thus obtained black colored steel strip may optionally be subjected to a chromate treatment to deposit a chromate film on the black colored steel strip and improve the corrosion resistance. Preferably, the chromate film may be deposited to a coating weight of about 5 to 150 mg/m$^2$ calculated as metallic chromium. An optional coating of a water-dispersible or water-soluble resin, or a silicate sol after applying the chromate film may result in a deepened blackness and improved scratch resistance of the product as well as further improved corrosion resistance. Preferably, the resin or the sol may be coated to a dry coating weight of 0.3 to 3 g/m$^2$. The application of the resin or the sol may be carried out together with the chromate treatment by combining the resin or the sol with chromic acid.

EXAMPLES

Examples of the present invention are given by way of illustration and not by way of limitation.

EXAMPLES 1 TO 15

A zinc-nickel alloy plated steel strip having a zinc content in the plated layer of 12% by weight was subjected to an electrolysis by either (1) alternating current electrolysis or (2) anodic electrolysis under the electrolytic conditions as described below in electrolyte solutions as shown in Table 1.

Electrolytic Conditions (1) Alternating current electrolysis

Anode electrolytic current density: 60 A/dm$^2$

Cathode electrolytic current density: 24 A/dm$^2$

Anode electrolytic current density/cathode electrolytic current density: 0.4

Cathodic electrolysis time/anodic electrolysis time: 0.2

Frequency of current alternation: 5 Hz

Electrolysis time: 5 sec.

(2) Anodic electrolysis

Current density: 50 A/dm$^2$

Electricity quantity: 200 C/dm$^2$

Evaluation of degree of blackness

The degree of blackness of the resulting black colored steel strip was measured by SM Color Computer manufactured by Suga Test Equipment K.K. The degree of blackness is expressed by L value, which is a value corresponding to lightness index. The L value ranges from 0 to 100, and a lower value indicate darker color and a higher value indicate lighter color. In the present invention, the steel strip having an L value of lower than 15 was determined to have sufficient degree of blackness, indicating that little corrosion products were formed in the electrolyte solution.

Figure 2:
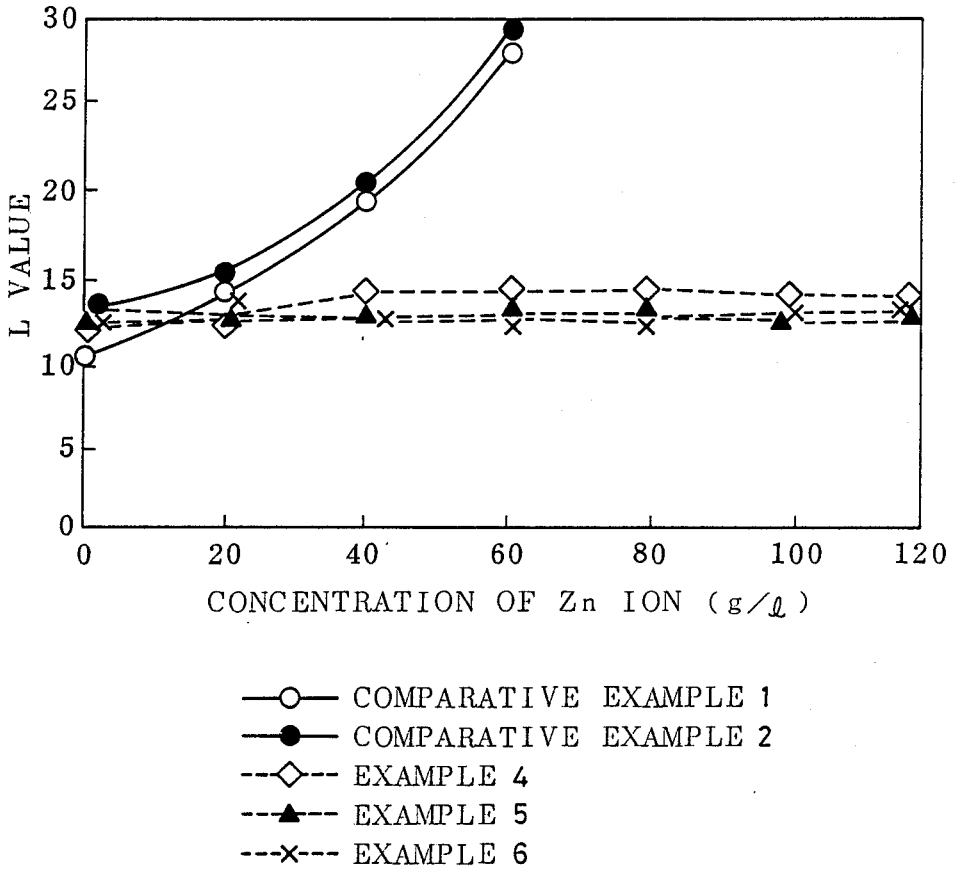
Figure 3:
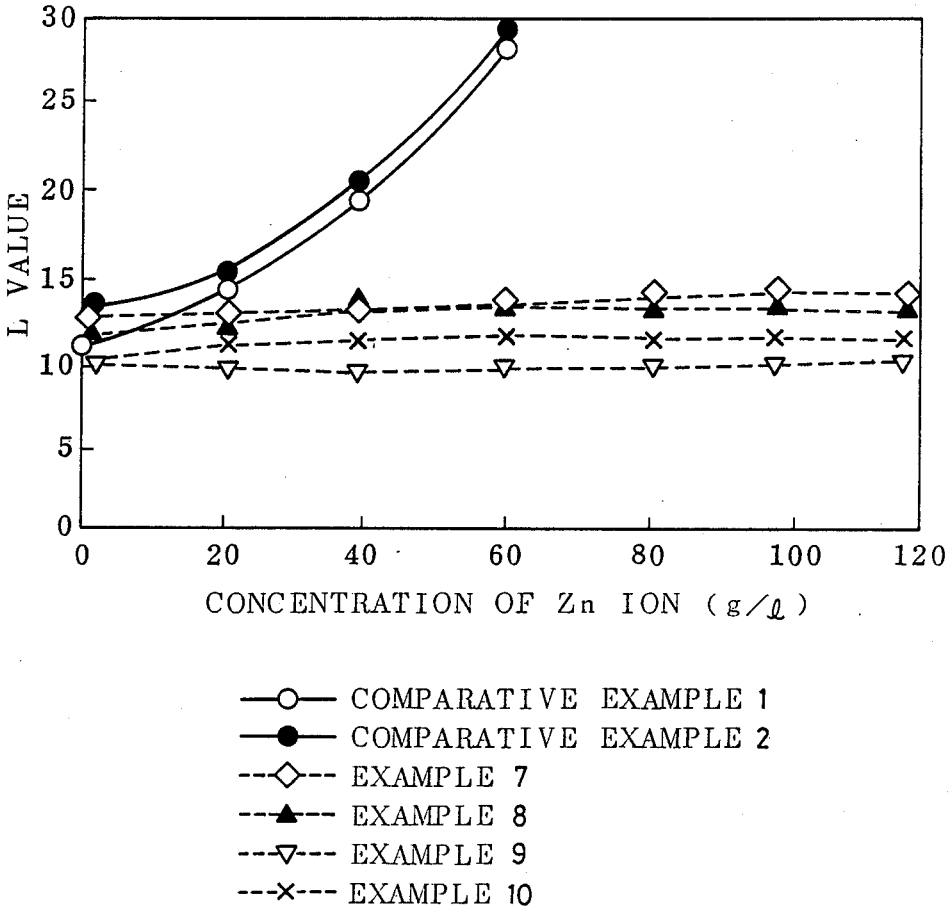
Figure 4:
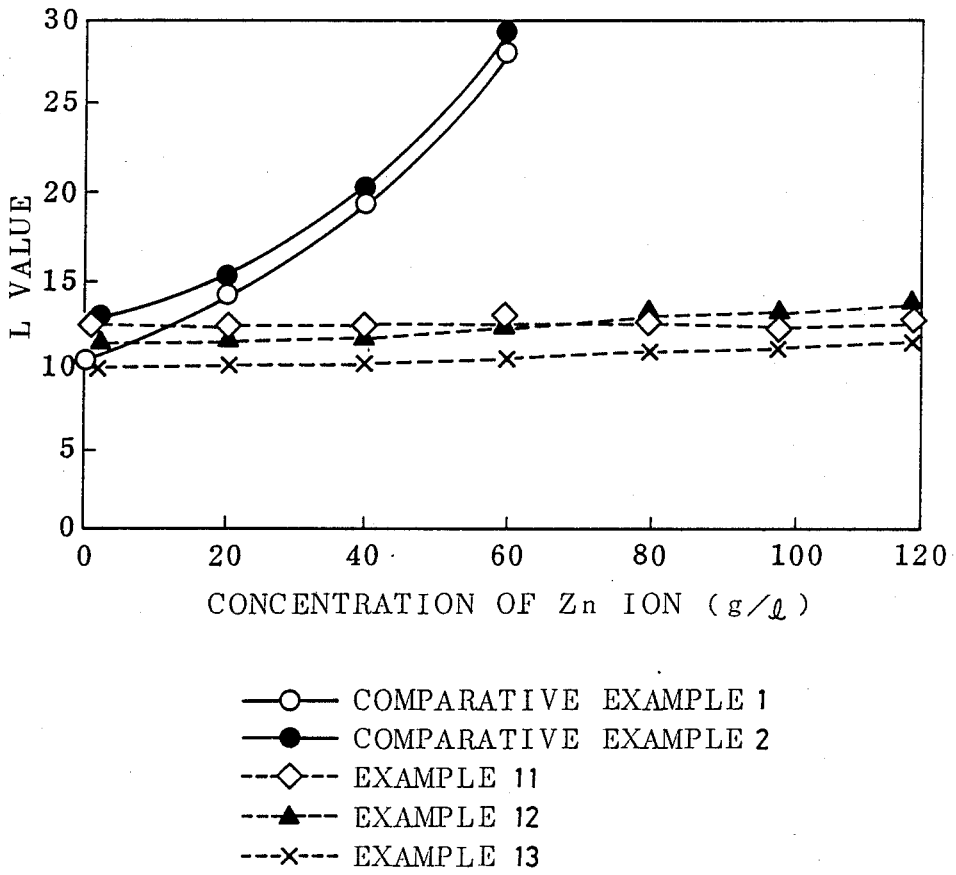
Figure 5:
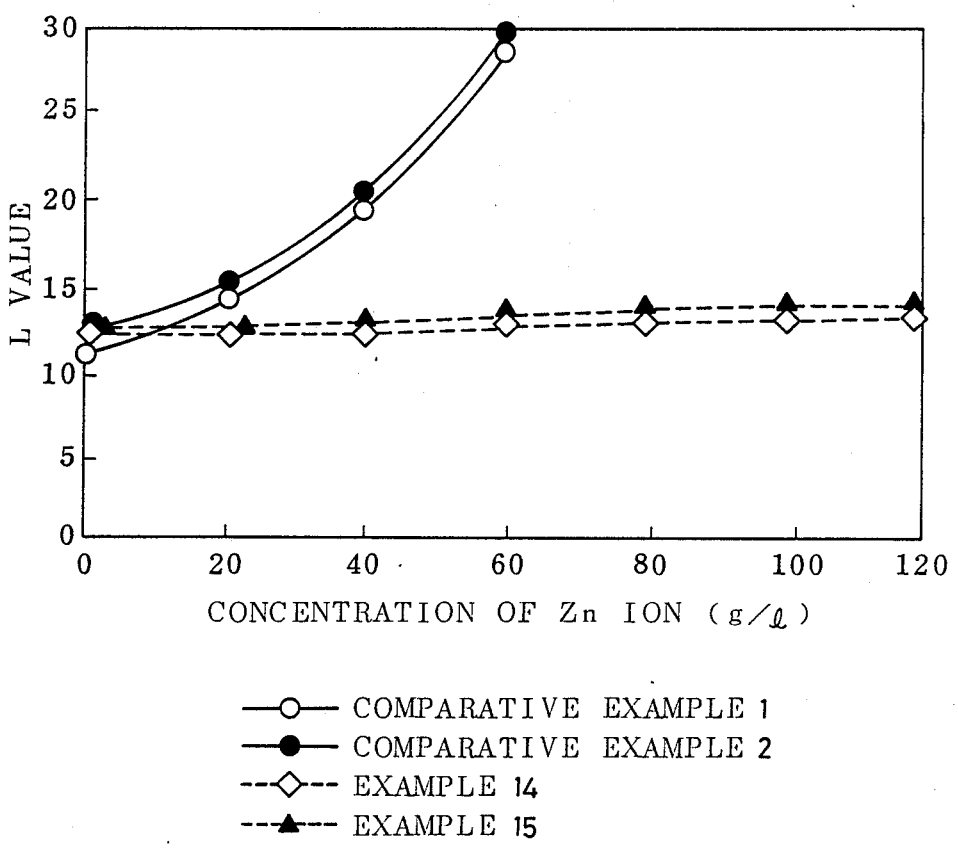

The results are depicted in FIGS. 1 to 5, wherein the L value is illustrated in relation to the concentration of Zn ion in the electrolyte solution.

COMPARATIVE EXAMPLES 1 AND 2

The procedure of Examples were repeated except that no inhibitor and/or complexing agent was added to the bath.

TABLE 1

| Example | Bath Composition | | Electrolysis |
|---|---|---|---|
| C.E.** 1 | sodium sulfate | 150 g/l | ACE*** |
| | nitrate ion | 20 g/l | |
| C.E. 2 | sodium sulfate | 150 g | AE**** |
| | nitrate ion | 20 g/l | |
| E.* 1 | sodium sulfate | 150 g/l | ACE |
| | nitrate ion | 20 g/l | |
| | thiourea | 2.0 g/l | |
| E. 2 | nitrate ion | 20 g/l | ACE |
| | sodium sulfate | 150 g/l | |
| | potassium iodide | 2.0 g/l | |
| E. 3 | sodium sulfate | 150 g/l | AE |
| | nitrate ion | 20 g/l | |
| | potassium chloride | 10 g/l | |
| E. 4 | sodium sulfate | 150 g | AE |
| | nitrate ion | 20 g/l | |
| | triethanolamine | 30 g/l | |
| | β-naphthylamine | 0.1 g/l | |
| E. 5 | sodium sulfate | 150 g | AE |
| | nitrate ion | 20 g/l | |
| | morpholine | 50 g/l | |
| | toluidine | 5.0 g/l | |
| E. 6 | sodium sulfate | 150 g | AE |
| | nitrate ion | 20 g/l | |
| | alkyldisulfide | 80 g/l | |
| | thiourea | 0.1 g/l | |
| E. 7 | sodium sulfate | 150 g | AE |
| | nitrate ion | 20 g/l | |
| | citric acid | 10 g/l | |
| E. 8 | sodium sulfate | 150 g | AE |
| | nitrate ion | 20 g/l | |
| | EDTA | 0.1 g/l | |

TABLE 1-continued

| Example | Bath Composition | | Electrolysis |
|---|---|---|---|
| E. 9 | sodium sulfate | 150 g | ACE |
| | nitrate ion | 20 g/l | |
| | EDTA | 2.0 g/l | |
| E. 10 | sodium sulfate | 150 g | ACE |
| | nitrate ion | 20 g/l | |
| | oxalic acid | 2.0 g/l | |
| E. 11 | sodium sulfate | 150 g | AE |
| | nitrate ion | 20 g/l | |
| | tartaric acid | 10 g/l | |
| E. 12 | sodium sulfate | 150 g | AE |
| | nitrate ion | 20 g/l | |
| | thiourea | 0.01 g/l | |
| | EDTA | 0.05 g/l | |
| E. 13 | sodium sulfate | 150 g | ACE |
| | nitrate ion | 20 g/l | |
| | thiourea | 3.0 g/l | |
| | oxalic acid | 3.0 g/l | |
| E. 14 | sodium sulfate | 150 g | AE |
| | nitrate ion | 20 g/l | |
| | triethanolamine | 0.01 g/l | |
| | tartaric acid | 0.01 g/l | |
| E. 15 | sodium sulfate | 150 g | AE |
| | nitrate ion | 20 g/l | |
| | EDTA | 0.1 g/l | |
| | citric acid | 0.1 g/l | |
| | thiourea | 0.1 g/l | |

*Example,
**Comparative Example,
***alternating current electrolysis,
****anodic electrolysis.

The results shown in FIGS. 1 to 5 indicate that the L value of the steel strips colored in the electrolyte solution containing the inhibitor and/or complexing agent is relatively constant compared with the L value of the steel strips colored in the electrolyte solution free of any inhibitor and/or complexing agent even when the concentration of the zinc ion is increased.

According to the present invention, deposition of the white corrosion product during the coloring of the Zn-Ni alloy plated steel strip is suppressed to enable the production of steel strips having significantly improved degree of blackness and uniform appearance.

According to the present invention, a stable mass production of the steel strips having superior properties in an industrial continuous line is also enabled since the life of the electrolyte solution is markedly extended by suppressing the formation of the corrosion products regardless of the increased zinc ion.

We claim:

1. A method for producing a black colored strip wherein a Zn-Ni plated steel strip is subjected to an electrolysis in an electrolyte solution containing 75 to 200 g/l of at least one member selected from the group consisting of hydroxide, sulfate, and chloride of sodium, potassium, or nickel; 2 to 100 g/l of nitrate ion; and at least one member selected from an inhibitor and a complexing agent in an amount sufficient to prevent corrosion products from being deposited on the steel strip.

2. The method according to claim 1 wherein said electrolysis is anodic electrolysis.

3. The method according to claim 1 wherein said electrolysis is alternating current electrolysis.

4. The method according to claim 1 wherein said inhibitor is at least one member selected from the group consisting of inhibitors primarily comprising a nitrogen compound, a sulfur compound, an amine, or a halogen compound.

5. The method according to claim 1 wherein said complexing agent is at least one member selected from the group consisting of citric acid, EDTA, oxalic acid, and tartaric acid.

6. The method according to claim 1 wherein said inhibitor and/or said complexing agent is added to said electrolyte solution to a total amount of about 0.001 to 100 g/l.

* * * * *